US005263890A

United States Patent [19]

Dent, IV

[11] Patent Number: 5,263,890

[45] Date of Patent: Nov. 23, 1993

[54] GREETING CARD MOUNTED PARTICULATE MATTER DISPERSION METHOD AND APPARATUS

[76] Inventor: Fredrick R. Dent, IV, 2102 N. Hills Pkwy., Atlanta, Ga. 30341

[21] Appl. No.: 709,169

[22] Filed: Jun. 3, 1991

[51] Int. Cl.[5] ..... A63H 37/00; G09F 1/00

[52] U.S. Cl. ..... 446/475; 40/124.1

[58] Field of Search ..... 446/475, 404, 415, 417, 446/418, 147, 148, 150; 272/27 N, 27 R, 27 B; 40/124.1

[56] References Cited

U.S. PATENT DOCUMENTS

| | | | |
|---|---|---|---|
| 2,111,179 | 3/1938 | Dillard | 272/27 B |
| 2,943,416 | 7/1960 | Barker | 446/148 |
| 4,787,160 | 11/1988 | Balsamo | 446/475 X |

*Primary Examiner*—Mickey Yu

*Attorney, Agent, or Firm*—Wigman, Cohen, Leitner & Myers

[57] ABSTRACT

A greeting card mounted particulate matter dispersion method and apparatus. In a preferred embodiment, the method of the present invention includes the steps of holding particulate matter such as confetti, seed or rice in a suitable open receptacle, attaching the receptacle to a greeting card, storing motive energy to turn or spin such receptacle, and releasing the stored energy, thereby providing kinetic energy to the receptacle and its contents, and thus dispersing the particulate matter from the open receptacle. An apparatus of a preferred embodiment of the invention includes a receptacle or envelope having an opening for holding particulate matter, an energy storage element for storing motive energy to be applied as kinetic energy to the receptacle and the particulate matter contained therein, and attachment elements for attaching the apparatus to a greeting card or other suitable surface.

24 Claims, 2 Drawing Sheets

GREETING CARD MOUNTED PARTICULATE MATTER DISPERSION METHOD AND APPARATUS

FIELD OF THE INVENTION

The present invention relates to a method and apparatus for dispersing, by imparting a velocity to throw or shower, particulate matter such as confetti, rice or seed from a greeting card.

BACKGROUND OF THE INVENTION

The use of greeting cards to provide a surprise upon the opening of the card has been the subject of many card developments, including the use of pop-up elements. The showering of confetti upon the opening of a greeting card would produce a major shock or surprise to the user and it is to this end that this invention is directed.

Several attempts have been made in the prior art to shower or otherwise randomly disperse particulate matter such as confetti from a greeting card. Among these are U.S. Pat. No. 4,787,160 to Balsamo which uses a rupturable packet of confetti which is triggered by the sender so that the recipient will cause the packet to rupture and thereby spew the confetti. British Patent No. 634,220 discloses a container held together by a string. Unwinding of the string and then rotating the confetti-filled container releases the confetti.

The prior art Balsamo device will not impart a velocity to the confetti and thus will not disperse as by showering or throwing out the confetti from a greeting card. Rather the Balsamo device merely spews out the confetti, apparently under the force of gravity. The British device is not readily adaptable to a greeting card.

SUMMARY OF THE INVENTION

The present invention is directed to a method and apparatus for dispersing particulate matter such as confetti, rice, seed or the like from a greeting card. The apparatus and method have the advantage of being adaptable to lay flat against a surface, such as the inside of a folded, closed greeting card.

The method of the present invention includes the steps of holding particulate matter such as confetti, seed or rice in a suitable open receptacle and imparting a velocity to the particulate matter. In a preferred embodiment, the method further comprises the steps of attaching the receptacle to a greeting card, storing motive energy, converting the stored energy to kinetic energy to turn or spin the receptacle and its contents and thereby imparting a velocity to the particulate matter when dispersing the particulate matter.

An apparatus of the invention includes a receptacle or envelope having an opening for holding particulate matter and means for imparting a velocity to the particulate matter, thereby dispersing the particulate matter. In a preferred embodiment, the apparatus further comprises energy storage means for storing motive energy to be applied as kinetic energy to the receptacle and the particulate matter contained therein, thus imparting velocity to the particulate matter, and attachment means for attaching the apparatus to a greeting card or other suitable surface.

More particularly, in a preferred embodiment, a triggerable confetti spinner, which may be sold separately for use with a greeting card or which may be permanently affixed to a greeting card prior to sale, comprises an envelope or other suitable receptacle for confetti or the like with the envelope connected through elastomeric members to attachment means for placement in a greeting card. The envelope with the confetti is temporarily sealed by a cover or sleeve fitted over the envelope and held in place by a suitable tape and the envelope is rotated to place the elastomeric members in torsion. The tape is then removed and the cover is left in place on the envelope and the card is then closed to prevent the covered envelope from spinning until the card is opened by the ultimate user or recipient. The unwinding of the elastomeric members results in spinning of the envelope, thereby causing the cover to come away from the envelope and the envelope to open and the particulate matter to be spun from the envelope.

With the foregoing and other advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

In the drawings which form part of the original disclosure of the invention.

DETAILED DESCRIPTION OF THE INVENTION

Figure 1:
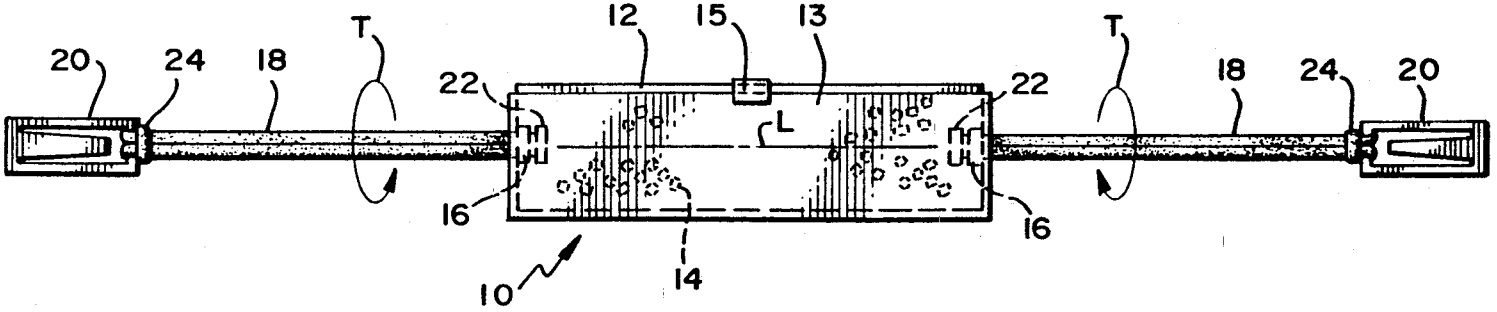
FIG. 1 shows a front elevation view of an embodiment of the invention.

Referring now to the drawings, there is illustrated in FIG. 1 a front elevation view of a preferred embodiment of the invention, designated generally by the numeral 10. The apparatus is comprised of an envelope 12 for holding particulate matter 14, such as confetti. Envelope 12 is covered by a cover 13 disposed over the open side (12*d*, FIG. 3) of the envelope 12, which holds the particulate matter 14 in envelope 12 until released by the ultimate recipient upon opening the card. Envelope 12 is preferably formed of an acetate film or other suitable materials. Slots 16 are located at each end of the envelope 12, through which are attached elastomeric members 18. Each elastomeric member 18 is attached to a fastener 20. The elastomeric member 18 may be attached as, for example, by a knot or loop 22 through slot 16 and a knot or loop 24 through fastener 20. The elastomeric member 18 can be preferably a rubber band or a suitable elastic strand, tied to the envelope 12 and fastener 20. A preferred fastener 20 is a paper clip.

Figure 2:
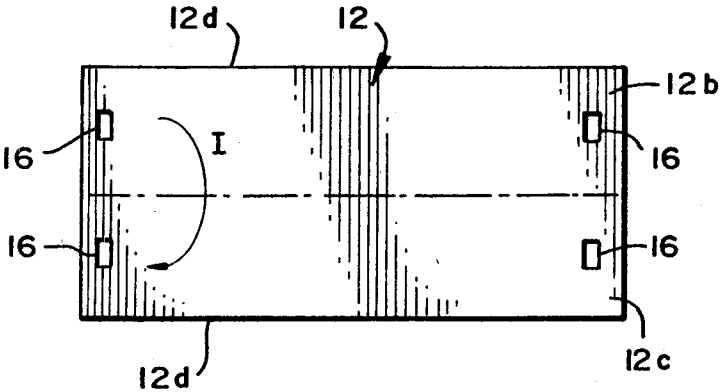
FIG. 2 shows a first embodiment of an unfolded particulate matter envelope.
Figure 3A:
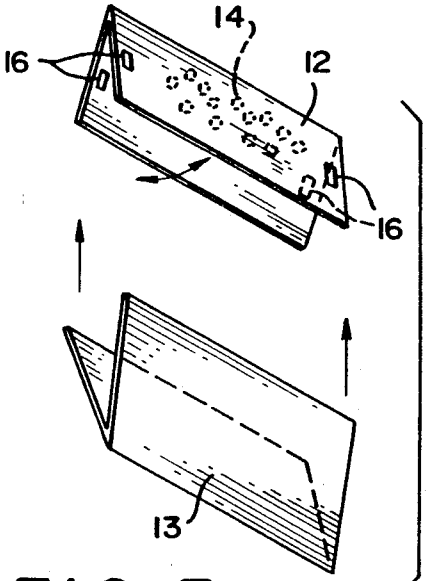
FIGS. 3*a* and 3*b* show unassembled and assembled views of a particulate matter envelope and cover of the first embodiment.
Figure 3B:
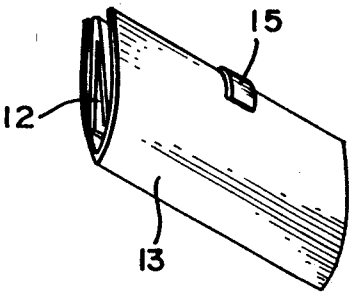

FIGS. 2 shows a preferred embodiment of an unfolded envelope 12 formed by folding a sheet of acetate film or other suitable material. As shown in FIG. 2, a preferred envelope 12 is formed by folding sheet panel 12*b* toward panel 12*c* along line 12*a*, essentially parallel to the longitudinal axis of the envelope sheet material, in the direction of arrow I, thereby forming a pocket having open side 12*d*. Slots 16 are provided for engagement with elastomeric members 18 (FIG. 1). As shown in FIGS. 3*a* and 3*b*, two such folded panels can be used to hold particulate matter. Envelope 12, having slots 16, forms the holder for particulate matter 14 and is enclosed by cover 13, formed identically as envelope 12, but without slots, with the fold line of cover 13 fitted over the open side of envelope 12 and held in place by tape 15. An elastomeric member 18 (FIG. 1) is attached to one slot 16 at each end of envelope 12. The attachment slots 16 which are engaged by elastomeric member 18 (FIG. 1) may be on the same panel of envelope 12 or on opposite panels so that elastomeric members 18 are attached diagonally. Alternative arrangements for holding particulate matter are contemplated. For example, two such envelopes 12 can be mounted back-to-back with open sides 12*d* facing in opposite directions, and each provided with a cover 15 mounted to enclose open sides 12*d*. Alternatively, the envelope 12 can be arranged with the open sides 12*d* facing in the same direction and approximately enclosed by cover 15.

The device 10 is assembled by attaching the elastomeric members 18 to slots 16 and then placing the particulate matter 14, such as confetti, rice or seed, in the open side (12*d*, FIG. 2) of the envelope opposite the fold line (12*a*, FIG. 2). The open sides are then closed by fitting a cover 13 (as shown in FIGS. 3*a* and 3*b*) over envelope 12 and then secured, as by being held closed by suitable means, such as removable tape 14 or the like (as shown in FIG. 3*b*). The device 10 can be stored, shipped, displayed and sold in this form. Alternatively, it can be mounted to a greeting card 30, as shown in FIG. 4 and stored, shipped, displayed and sold in such form.

Figure 4:
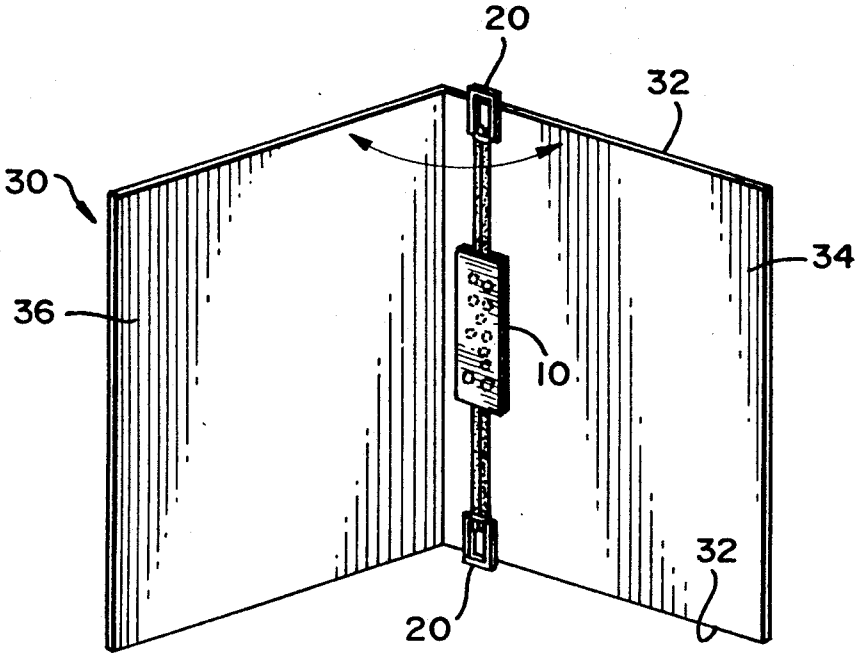
FIG. 4 shows a perspective view of an embodiment of the invention mounted in a greeting card.

As shown in FIG. 4, the device 10 is mounted at edges 32 by fasteners 20 to fit against panel 34 of the card 30. The device 10 is preferably located near the fold of card 30. In operation, a device 10, mounted to card 30 is "armed" by slowly winding the envelope 12 about the longitudinal axis L thereof in the direction of arrow T, FIG. 1. This results in storing of torsional energy in the elastomeric members 18. The tape 15 (FIG. 3*b*) is then removed with cover 13 left in place and then the cover 36 of the card 30 is closed against the device 10 and panel 34. When the card is opened, the device 10 is "triggered" or released, resulting in the unwinding of the wound elastomeric members 18, the spinning of envelope 12, the displacement of cover 13, imparting of a velocity to the particulate matter 14, and the release of the particulate matter 14 through the open side or sides of envelope 12. Alternatively, the tape 15 can be removed before the envelope 12 is wound about its longitudinal axis L, but this is less preferred than winding before removing the tape.

Figure 5:
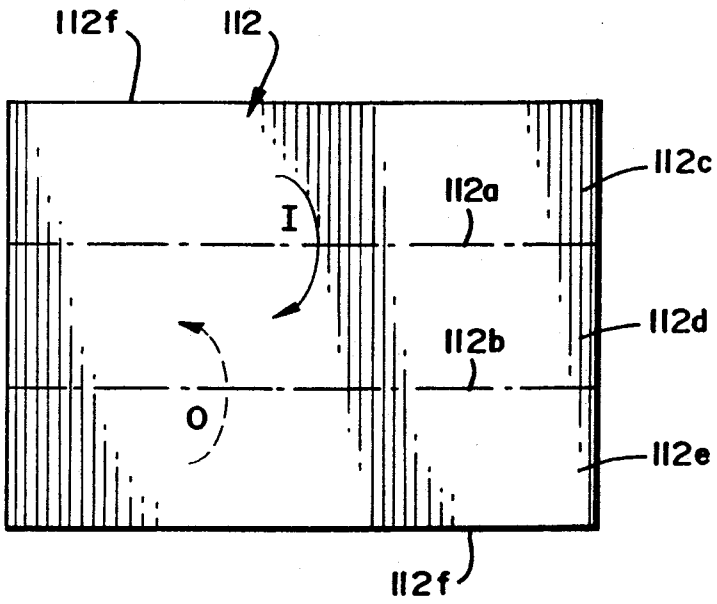
FIG. 5 shows a second embodiment of an unfolded particulate matter envelope.

Finally, an alternative envelope 112, FIG. 5, is formed by folding along lines 112*a* and 112*b*, essentially parallel to the sheet longitudinal axis, to form two pockets having opposing open sides. The folds are accomplished by folding panel 112*c* toward the front of panel 112*d* in the direction of arrow I and panel 112*e* toward the back of panel 112*d* in the direction of arrow O. This results in two pockets having open sides designated 112*f*. Appropriately located slots (not shown) are formed at the edges of the sheet to engage elastomeric members. It is contemplated that a fold arrangement (not shown), including a multiplicity of fold lines, can be used with the sheet folded in accordian fashion and having the open sides facing in the same direction. Such envelopes are enclosed by a cover as in the first embodiment or a pair of covers, as necessary, in order to keep the particulate matter in the envelope.

While a preferred embodiment has been disclosed, the invention is not limited to the configuration and materials of such embodiment. It is contemplated that elastomeric media other than a rubber band, such as an elastic strand, can be used. Attachment means such as a staple, tape or glue are contemplated. Acetate, paper or plastic can be used for the envelope. The invention contemplates imparting velocity to the particulate matter, as by compressed coil or leaf springs or torsional springs as well as elastomeric members. Also contemplated is use of the motion of opening the card itself to impart a velocity to the particulate matter.

The method of the invention includes the steps of holding particulate matter in a receptacle having an opening and imparting a velocity to the particulate matter. The method further comprises the steps of attaching the receptacle to a greeting card, storing motive energy, releasing the stored energy to turn or spin such receptacle, thereby converting the stored motive energy to kinetic energy to the receptacle and its contents and thus dispersing the particulate matter.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. A method for dispersing particulate matter from a greeting card comprising the steps of:

holding the particulate matter in a receptacle having an opening, said receptacle adapted for motion independent of said greeting card, imparting a velocity to said receptacle, thereby dispersing the particulate matter from the receptacle opening.

2. An apparatus for dispersing particulate matter from a greeting card, comprising:

means for releasably holding particulate matter, and means, cooperating with said holding means, for imparting a velocity to the particulate matter, said velocity imparting means comprising means for storing motive energy, said motive energy storing means adapted to convert said stored motive energy to kinetic energy of said holding means.

3. An apparatus as in claim 2, further comprising:

first means for attaching said velocity imparting means to said particulate matter holding means, and second means for attaching said velocity imparting means to the greeting card.

4. An apparatus as in claim 2, wherein said means for releasably holding particulate matter comprises an envelope open at one or more sides.

5. An apparatus as in claim 4, wherein said envelope is selected from the group consisting of paper and plastic.

6. An apparatus as in claim 3, wherein said velocity imparting means comprises at least one elastomeric member, said elastomeric member adapted to be placed in torsion.

7. An apparatus as in claim 6, wherein said at least one elastomeric member comprises a pair of rubber bands attached to ends of said means for releasably holding particulate matter.

8. An apparatus as in claim 6, wherein said at least one elastomeric member comprises a pair of elastic strands attached to ends of said means for releasably holding particulate matter.

9. An apparatus as in claim 6, wherein said first attaching means comprises a knot in said elastomeric member tied through a slot in said means for releasably holding particulate matter.

10. An apparatus as in claim 6, wherein said second attaching means comprises a knot in said elastomeric member tied to a paper clip.

11. Apparatus as in claim 4, wherein said envelope is adapted to be enclosed at one or more open sides by a cover means fitted over said one or more open sides and secured in place.

12. Apparatus as in claim 4, wherein said envelope comprises a sheet folded along one or more lines essentially parallel to a longitudinal axis of said sheet, thereby forming a pocket for holding particulate matter.

13. A method for dispersing particulate matter from a greeting card comprising the steps of:

holding the particulate matter in a receptacle having an opening, imparting a velocity to the particulate matter, thereby dispersing the particulate matter from the receptacle opening, said velocity imparting step comprising the steps of storing motive energy and converting said stored motive energy to kinetic energy of the particulate matter held in the receptacle.

14. A greeting card for dispersing particulate matter, comprising:

a card, means for releasably holding particulate matter, and means cooperating with said holding means, for imparting a velocity to the particulate matter, said velocity imparting means comprising means for storing motive energy, said motive energy storing means adapted to convert said stored motive energy to kinetic energy of said holding means.

15. A greeting card as in claim 14, further comprising:

first means for attaching said velocity imparting means to said particulate matter holding means, and second means for attaching said velocity imparting means to said card.

16. A greeting card as in claim 14, wherein said means for releasably holding particulate matter comprises an envelop open at one or more sides.

17. A greeting card as in claim 16, wherein said envelope is selected from the group consisting of paper and plastic.

18. A greeting card as in claim 15, wherein said velocity imparting means comprises at least one elastomeric member, said elastomeric member adapted to be placed in torsion.

19. A greeting card as in claim 18, wherein said at least one elastomeric member comprises a pair of rubber bands attached to ends of said means for releasably holding particulate matter.

20. A greeting card as in claim 18, wherein said at least one elastomeric member comprises a pair or elastic strands attached to ends of said means for releasably holding particulate matter.

21. A greeting card as in claim 18, wherein said first attaching means comprises a knot in said elastomeric member tied through a slot in said means for releasably holding particulate matter.

22. A greeting card as in claim 18, wherein said second attaching means comprises a knot in said elastomeric member tied to a paper clip.

23. A greeting card as in claim 16, wherein said envelope is adapted to be enclosed at one or more open sides by a cover means fitted over said one or more open sides and secured in place.

24. A greeting card as in claim 16, wherein said envelope comprises a sheet folded along one or more lines essentially parallel to a longitudinal axis of said sheet, thereby forming a pocket for holding particulate matter.

* * * * *